US008061089B2

(12) United States Patent
Russell

(10) Patent No.: US 8,061,089 B2
(45) Date of Patent: Nov. 22, 2011

(54) TURF ANCHOR FOR USE WITH A MAILBOX OR THE LIKE

(76) Inventor: Sandra J. Russell, Atwater, OH (US)

( * ) Notice: Subject to any disclaimer, the term of this patent is extended or adjusted under 35 U.S.C. 154(b) by 699 days.

(21) Appl. No.: 12/217,180

(22) Filed: Jul. 1, 2008

(65) Prior Publication Data

US 2010/0000164 A1 Jan. 7, 2010

(51) Int. Cl.
*E02D 5/74* (2006.01)

(52) U.S. Cl. ..... 52/165; 52/156; 52/159

(58) Field of Classification Search ..... 52/165, 52/155, 156, 159
See application file for complete search history.

(56) References Cited

U.S. PATENT DOCUMENTS

| | | | | | |
|---|---|---|---|---|---|
| 492,520 | A | * | 2/1893 | Hedges | 52/156 |
| 852,555 | A | * | 5/1907 | Glassco | 52/116 |
| 948,672 | A | * | 2/1910 | Muller | 47/47 |
| 1,038,147 | A | | 9/1912 | Johnson | |
| 2,480,197 | A | | 8/1949 | Rasmussen | |
| 3,195,898 | A | | 7/1965 | Respini | |
| 4,951,904 | A | | 8/1990 | Obenshain | |
| 5,065,975 | A | * | 11/1991 | Giles | 248/545 |

* cited by examiner

*Primary Examiner* — Basil Katcheves
(74) *Attorney, Agent, or Firm* — Sand & Sebolt

(57) ABSTRACT

A turf anchor typically includes an upright and three or four spikes which are insertable into the ground to mount the upright above ground with substantial stability. The turf anchor may be pressed by foot or hammered to force the spikes into the ground and may be used for securing a mailbox or various other outdoor items.

20 Claims, 8 Drawing Sheets

TURF ANCHOR FOR USE WITH A MAILBOX OR THE LIKE

BACKGROUND OF THE INVENTION

1. Technical Field

The present invention relates generally to turf anchors for securing various objects to the ground. More particularly, the present invention relates to a turf anchor for use with a mailbox or the like. Specifically, the present invention relates to a turf anchor which utilizes at least three spikes which are inserted into the ground to provide substantial stability to a post, mailbox, and so forth.

2. Background Information

Although there are a variety of anchoring systems for anchoring a mailbox or above-ground posts to the ground, the installation of some of these systems may be cumbersome and rather time consuming. In addition, many posts are made of wood or treated wood which ultimately rots away so as to require relatively frequent replacements. Other systems utilize one or two spikes which are forced into the ground but which will not provide suitable stability for a mailbox or post mounted items which require greater stability. The present invention addresses these and other concerns in the art.

BRIEF SUMMARY OF THE INVENTION

The present invention provides an apparatus comprising an upright having an upper end and a lower end whereby the upright is adapted to be positioned with its lower end adjacent the ground and extend upwardly therefrom to its upper end; a turf anchor secured to the upright; and first, second and third substantially vertical spikes on the turf anchor which are spaced from one another and extend downwardly below the lower end of the upright and are configured to be pressed downwardly into the ground to secure the upright to the ground.

The present invention also provides a method comprising: securing an upright adjacent a lower end thereof to a turf anchor; pressing first, second and third substantially vertical spikes of the turf anchor into the ground to secure the upright to the ground so that the upright extends upwardly from the ground to an upper end.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
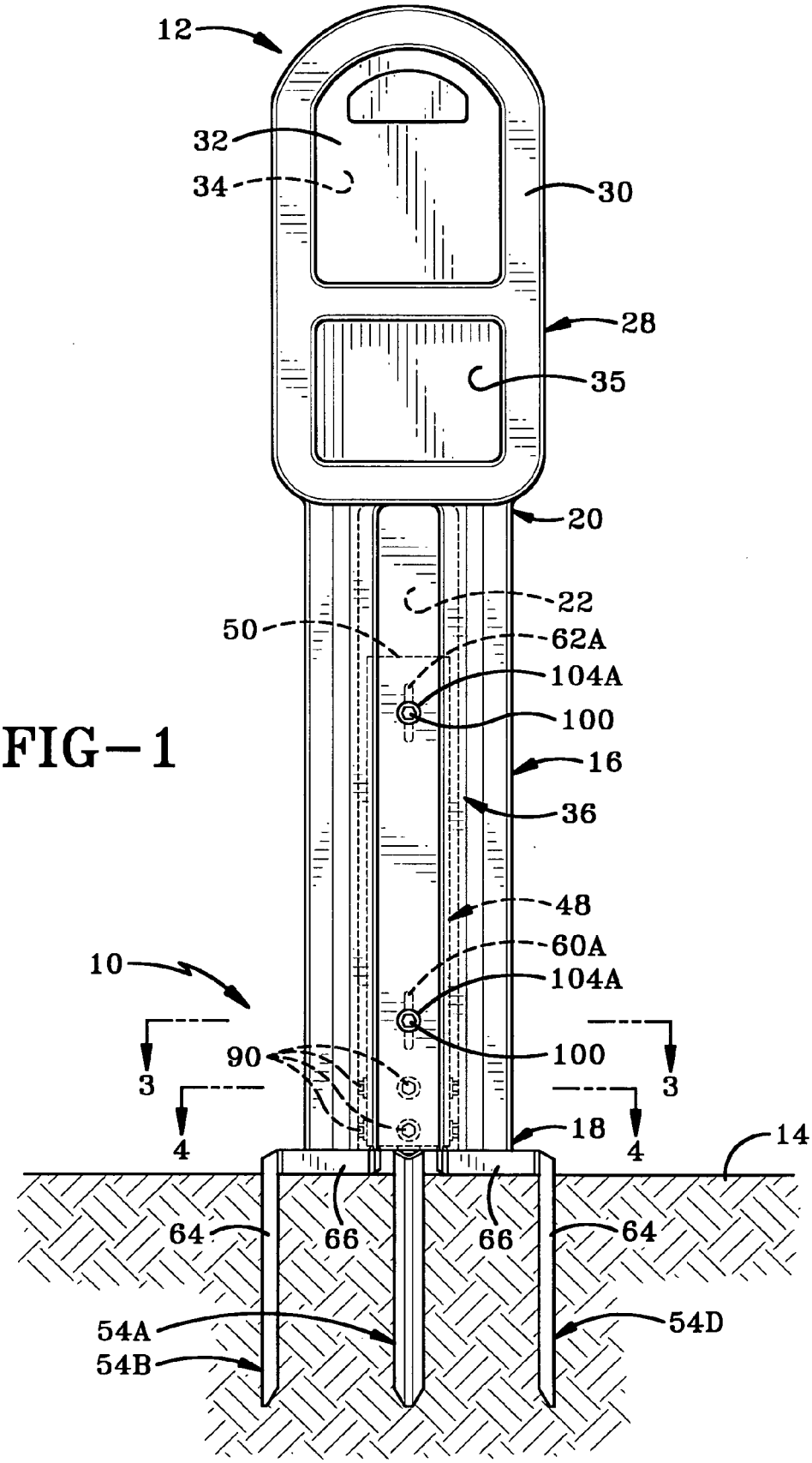
FIG. 1 is a front elevational view of the turf anchor of the present invention shown in use with a mailbox.

The turf anchor assembly of the present invention is showing generally at 10 in FIG. 1 for anchoring a mailbox assembly 12 to the turf, soil, or ground 14. Mailbox assembly is typically on the order of about four feet tall. Mailbox assembly 12 includes a mailbox upright or post 16 having lower and upper ends 18 and 20 with a rearwardly opening cavity 22 extending from lower end 18 to upper end 20. Cavity 22 also opens downwardly whereby cavity 22 has a rear entrance opening 24 (FIG. 3) at the back of post 16 and a bottom entrance opening 26 (FIG. 2) at lower end 18. Mailbox assembly 12 further includes a box unit 28 rigidly secured to post 16 at upper end 20. Box unit 28 includes a housing 30 with a door 32 vertically mounted thereon for accessing an interior chamber 34 formed in housing of 30 for receiving therein letters and other mail. Door 32 is typically hingedly mounted on housing 30 or may slide in and out in order to provide access to the interior chamber 34. A newspaper receiving cavity 35 may also be formed in housing 30 below interior chamber 34. All of the components forming mailbox assembly 12 are substantially rigid and in the exemplary embodiment are formed of plastic.

Figure 3:
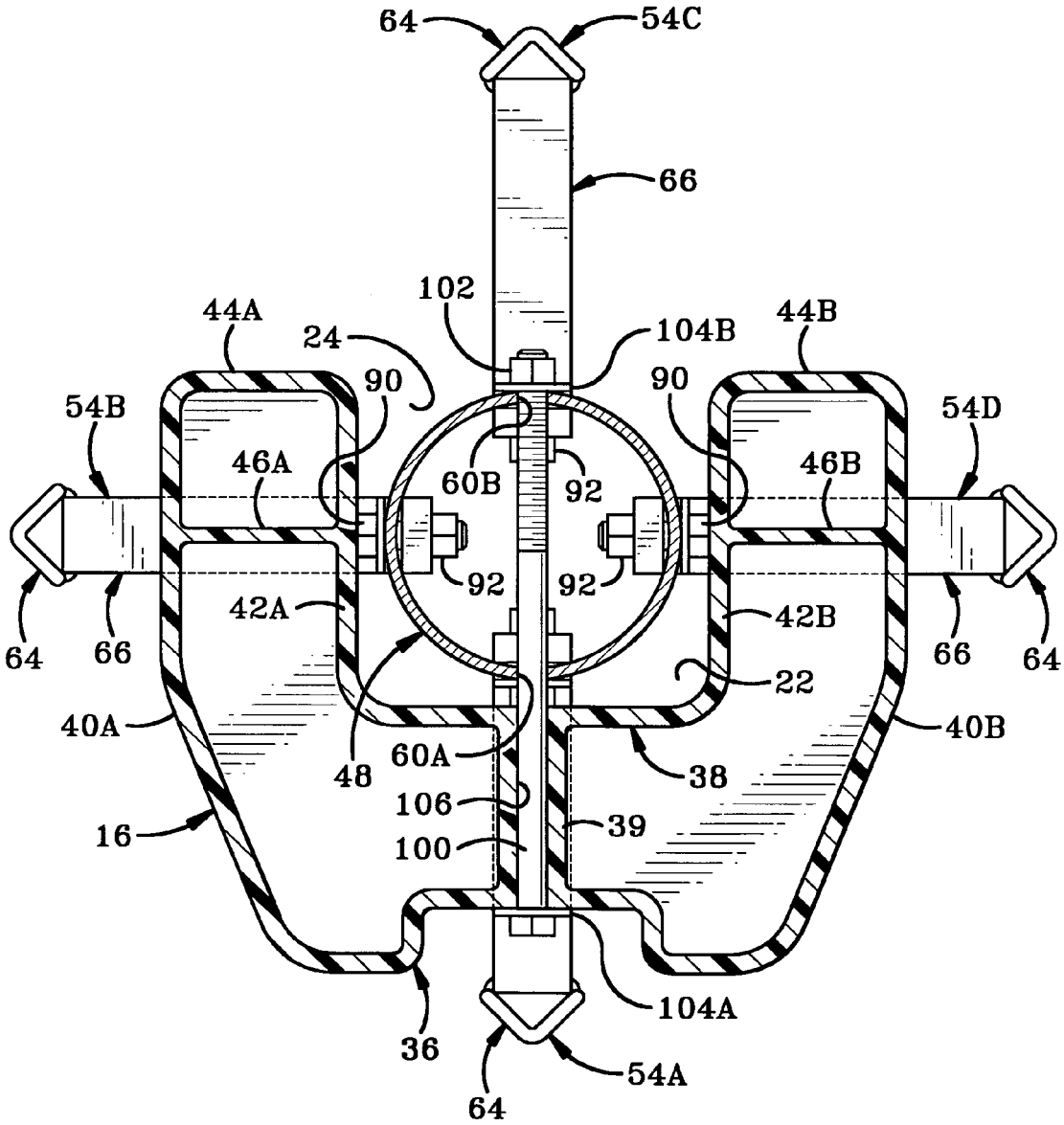
FIG. 3 is a sectional view taken on line 3-3 of FIG. 1.

As shown in FIG. 3, post 16 in the exemplary embodiment is a generally hollow structure having a double walled construction. More particularly, post 16 has a front section which includes a vertical front wall 36, a vertical intermediate wall 38 spaced rearwardly therefrom and one or more connecting walls 39 rigidly connected to and extending between walls 36 and 38. Post 16 is bilaterally symmetrical about a vertical plane which extends from its front to its rear and thus includes two mirror image side sections. These side sections respectively include vertical outer side walls 40A and 40B respectively connected to the outer ends of front wall 36 and extending rearwardly therefrom, and vertical inner side walls 42A and 42B respectively rigidly connected to the outer ends of intermediate wall 38 and extending rearwardly there from. Post 16 further includes back walls 44A and 44B which are respectively rigidly connected to the corresponding outer and inner side walls at the rear thereof. Post 16 may further include brace walls such as brace walls 46A and 46B which are shown extending between and connected to the respective inner and outer side walls in order to provide strength to the posts, similar to wall 39.

With primary reference to FIGS. 1-4, turf anchor assembly 10 includes a rigid upright or support post 48 having an upper end 50 and a lower end 52 with four stake members 54A-D rigidly secured to post 48 adjacent lower end 52. More particularly, stake members 54A and 54C are respectively front and rear stake members while stake members 54B and 54D are first and second opposed lateral or side stake members. In the exemplary embodiment, post 48 is a cylindrical pipe although it may be configured as a solid structure and may have a cross sectional shape such as square or another geometric shape. Upper and lower ends 50 and 52 of post 48 define between a height which is typically in the range of 18 to 30 inches, more typically 20 to 28 inches and usually 22 to 26 inches although this may vary. In the exemplary environment, post 48 has an outer diameter of about 3.5 inches and typically falls within a range of 2.0 to 5.0 inches and more typically 2.5 to 4.5 inches or 3.0 to 4.0 inches. Four sets of first and second through holes 56 and 58 (FIG. 5) are formed through the side wall of post 48 extending from its outer surface to its inner surface adjacent lower end 52. Each of the first holes 56 is vertically spaced upwardly and vertically aligned with the corresponding second hole 58 of the given set. Each set of holes 56 and 58 are in the exemplary embodiment circumferentially spaced around post 48 at about 90 degrees. Spaced upwardly a short distance from the front and rear sets of holes 56 and 58 are front and rear vertically elongated lower slots 60A and 60B which are aligned with one another. Adjacent and spaced downwardly from upper end 50 are likewise a pair of vertically elongated front and rear upper slots 62A and 62B formed through the side wall of post 48. Upper slots 62A and 62B are respectively vertically aligned with lower slots 60A and 60B.

Stake members 54 are generally Z-shaped, and are formed of rigid material such as metal, rigid plastic, or another suitable rigid material. Although bare metal may be used in forming stake members 54, it is preferred that paint or another protective coating is used when stake members are formed primarily of a corrosive metal in order to prevent or minimize corrosion when the turf anchor is mounted in ground 14. Each of stake members 54 includes a vertical spike 64, a horizontal radial arm 66 which serves as a foot press or hammering surface, and a vertical mounting leg 68. Each spike 64 has upper and lower ends 70 and 72 defining there between a height or length which in the exemplary embodiment is about 12 inches and typically falls within the range of about 6 to 18 inches, 8 to 16 inches, or 10 to 14 inches although this may vary depending in part on the type of soil into which spikes 64 are to be inserted. Likewise, each mounting leg 68 has upper and lower ends 74 and 76 defining there between a length which in the exemplary embodiment is about 5 inches and typically about 3 to 6 inches. Each radial arm 66 has an inner end 78 which is rigidly secured to leg 68 adjacent lower end 76 thereof and extends radially outwardly therefrom to an outer end 80, at which spike 64 is rigidly secured adjacent upper end 70 thereof. Inner and outer ends 78 and 80 define therebetween a length which in the exemplary embodiment is about 4 to 5 inches and typically within the range of 3 to 6, 7 or 8 inches. In the exemplary embodiment, spike 64 is parallel to leg 68 while arm 66 is perpendicular to each of spike 64 and leg 68. Each spike 64 adjacent lower end 72 is tapered in order to form a tapered or pointed tip 82. An optional drain opening 84 which allows water to pass there through is formed at upper end 70 of spike 64 and is bounded by outer end 80 of arm 66. In the exemplary embodiment, spike 64 is formed of an angle and thus has a V-shaped cross-section as viewed from above. In the exemplary embodiment, arm 66 has a tubular structure having a substantially square cross section and mounting leg 68 is a solid vertically elongated structure. However, the specific configurations each of members 64, 66, and 68 may vary within the scope of the invention.

Figure 2:
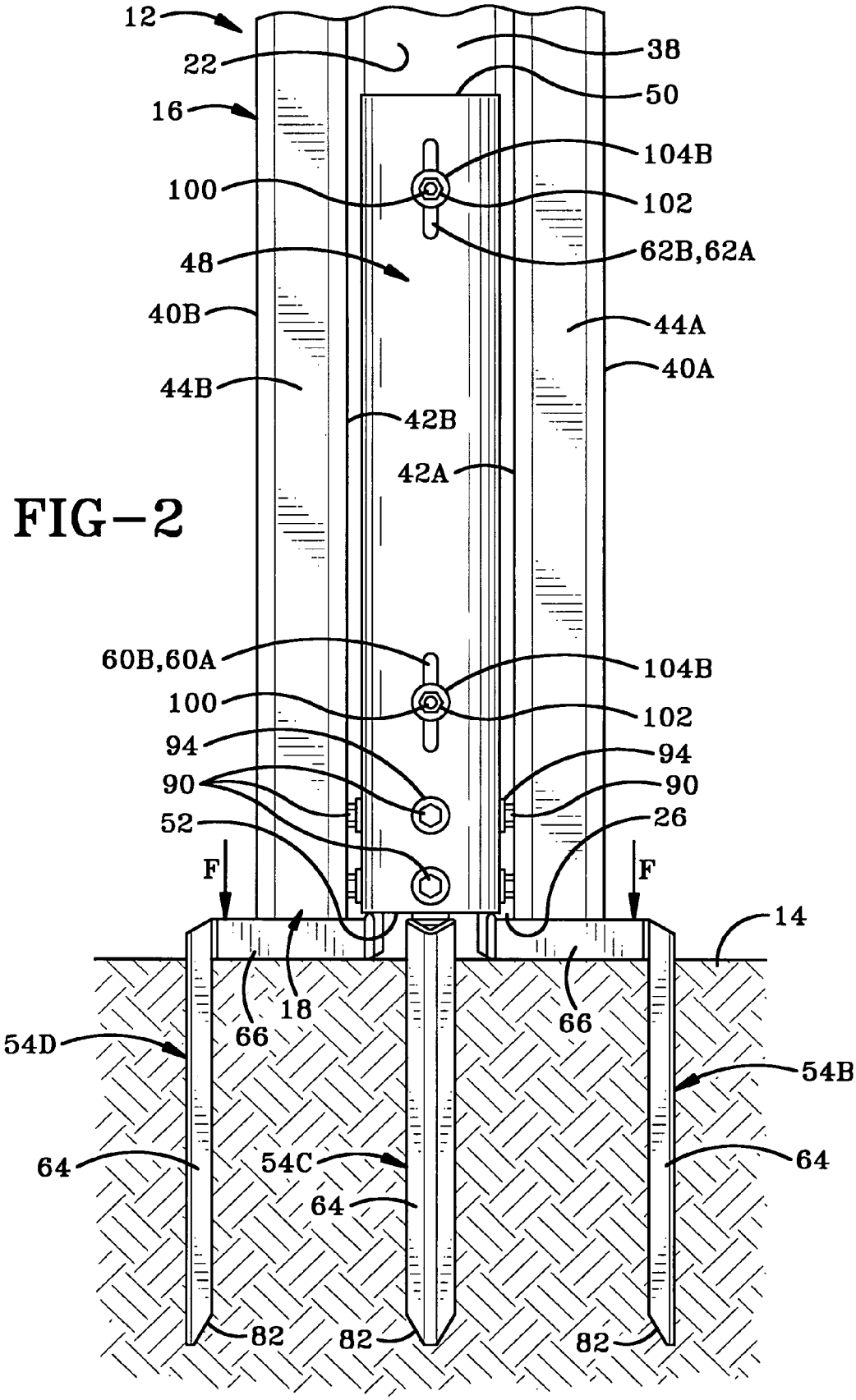
FIG. 2 is an enlarged rear elevational view of the turf anchor and a lower portion of the mailbox post.
Figure 4:
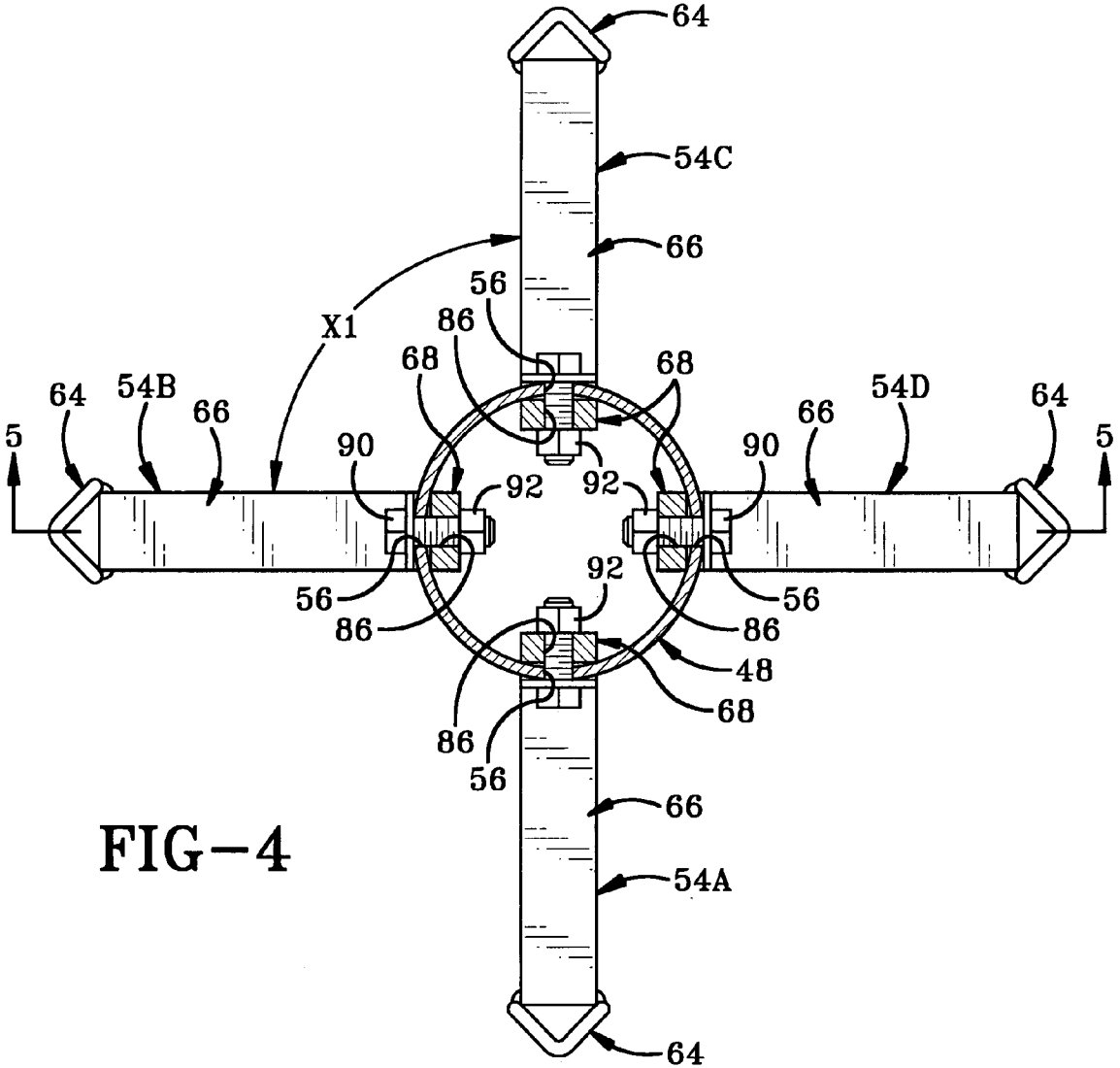
FIG. 4 is a sectional view taken on line 4-4 of FIG. 1.
Figure 4A:
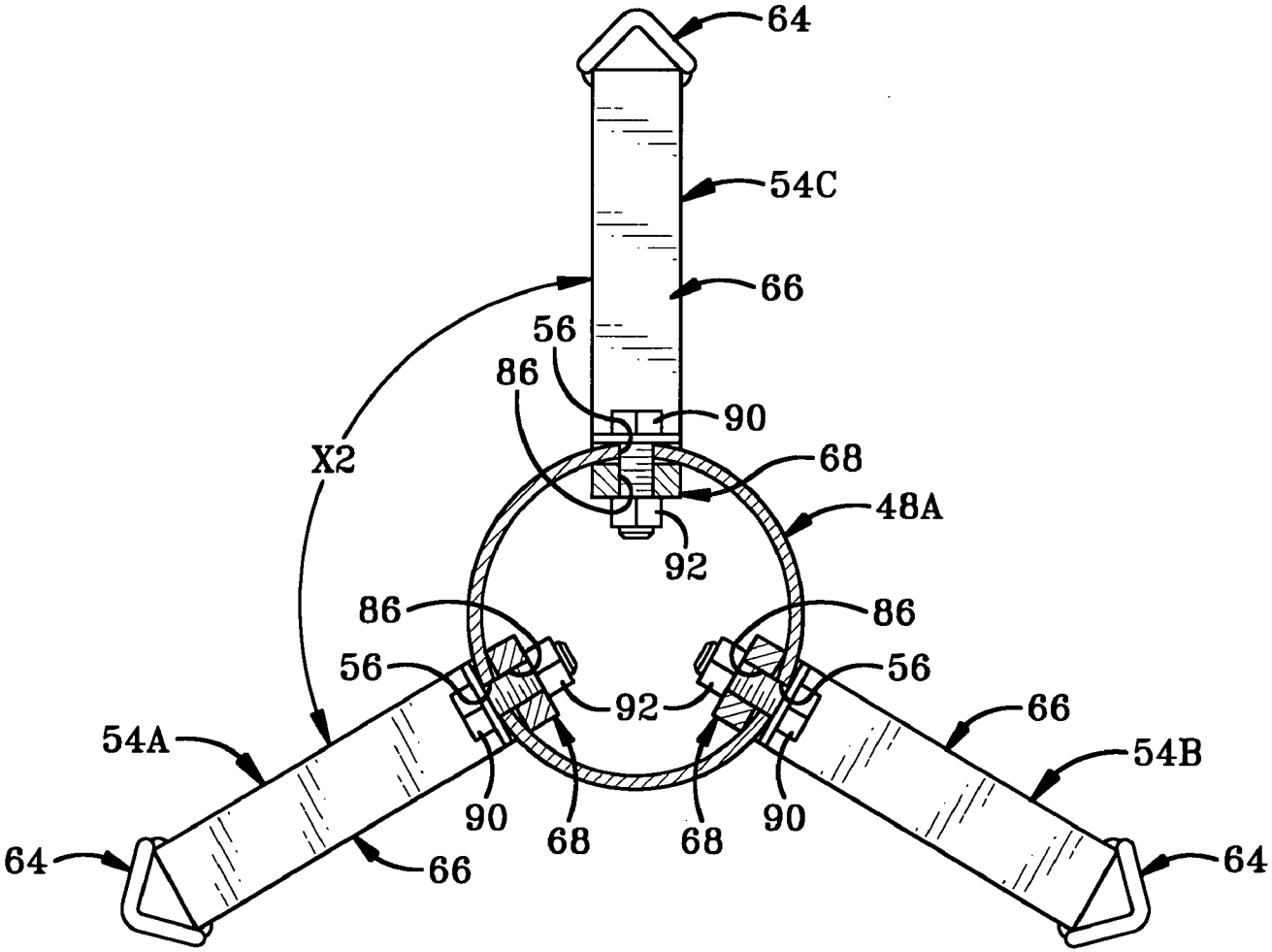
FIG. 4A is a view similar to FIG. 4 showing three stake members mounted on the support post.
Figure 6:
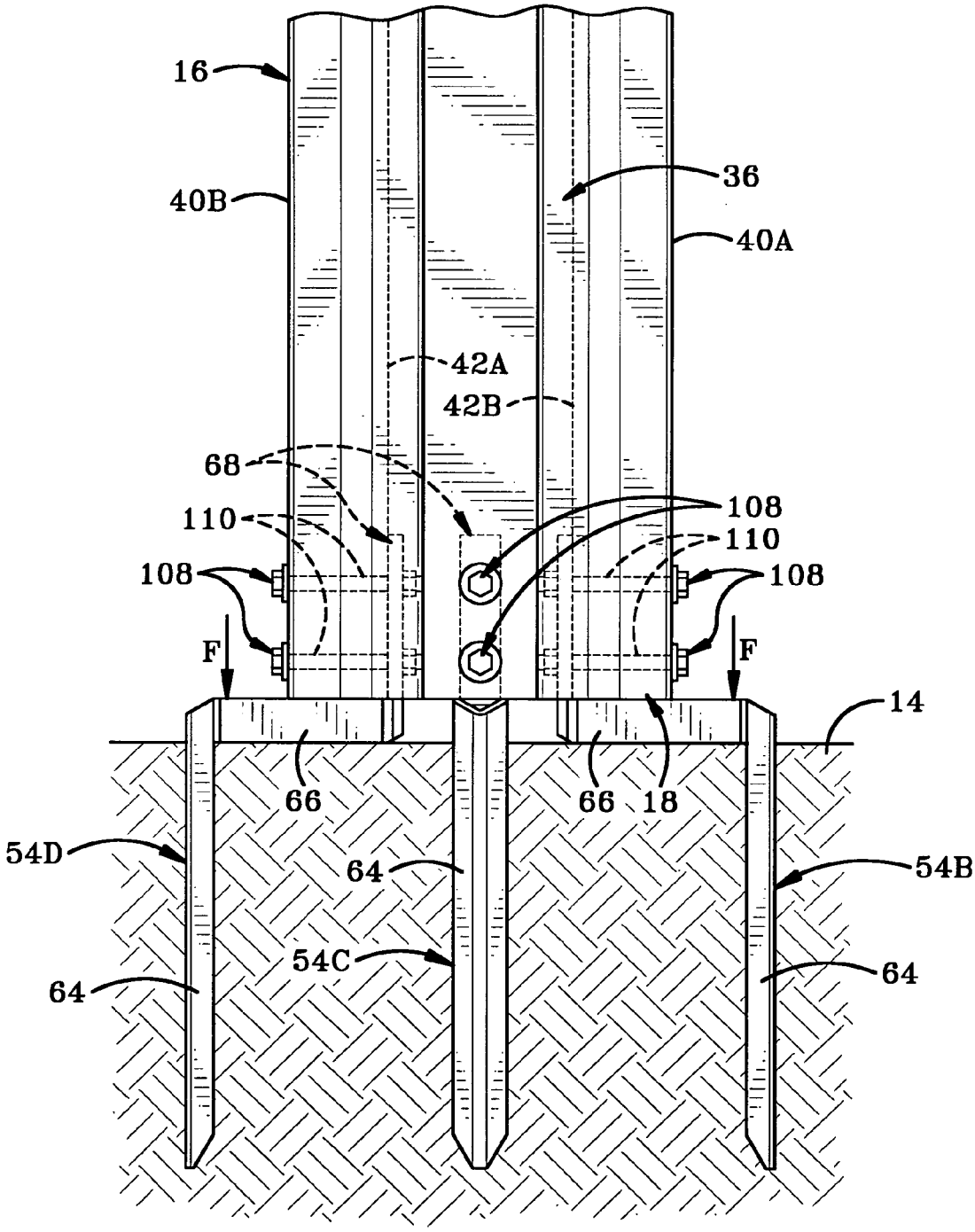
FIG. 6 is a rear elevational view showing the stakes mounted directly on the mailbox post.

As shown in FIG. 4, each of spikes 64 is spaced radially outwardly of post 48, typically about the same distance as the length of the corresponding arm 66, said lengths having been noted above. Each spike 64 is about evenly spaced or equidistant from the adjacent two spikes 64. In the configuration shown in FIG. 4, each of the adjacent stake members 54 extends outwardly approximately at right angles to one another, as indicated by angle X1, which is thus typically about 90 degrees. The spikes 64 of opposed pairs of stake members such as stake numbers 54B and 54D, or 54A and 54C, are thus circumferentially spaced at about 180 degrees relative to the center of post 48 so that the corresponding opposed arms 66 are substantially collinear. An alternate option is show in FIG. 4A in which only three stake members 54A-C are secured to an alternate post 48A so that each of the adjacent stake members is spaced circumferentially equally from one another at about 120 degrees relative to the center of post 48A as indicated by angle X2. Each of spikes 64 in this configuration is about evenly spaced or equidistant from the other two spikes 64. Post 48A is substantially the same as post 48 except that the corresponding holes and fasteners are likewise positioned at about 120 degrees from one another for mounting the three stake members thereon. In the three-stake or four-stake configuration, spikes 64 are positioned radially outwardly of mailbox post 16, as illustrated in FIGS. 1, 2 and 6. These figures also show that lower end 18 is seated on the upwardly facing upper surface of each arm 66 and that lower end 52 of post 48 is positioned closely adjacent or in contact with the upper surfaces of arms 66. Thus, post 16 and post 48 are spaced upwardly of the upper surface of ground 14 a relatively short distance, such as about an inch whereby each of these posts is entirely above ground when spikes 64 are inserted into the ground 14. Preferably, the height of each arm 66 is no more than 1.5 inches and preferably no more than 1.0 inches whereby the portion of arm 66 or spike 64 which is disposed outward of the outer perimeter of post 16 extends no higher than 1.0 to 1.5 inches above the upper surface of ground 14. This helps to minimize or eliminate these components being hit with lawn mower blades and preferably minimizes or eliminates personal injury such as to a person's foot.

Figure 5A:
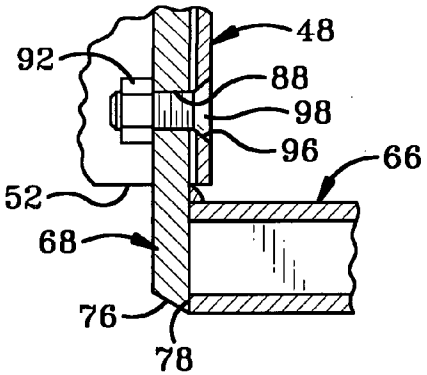
FIG. 5A is a sectional view similar to a portion of FIG. 5 showing an alternate bolt with a countersunk head.
Figure 5:
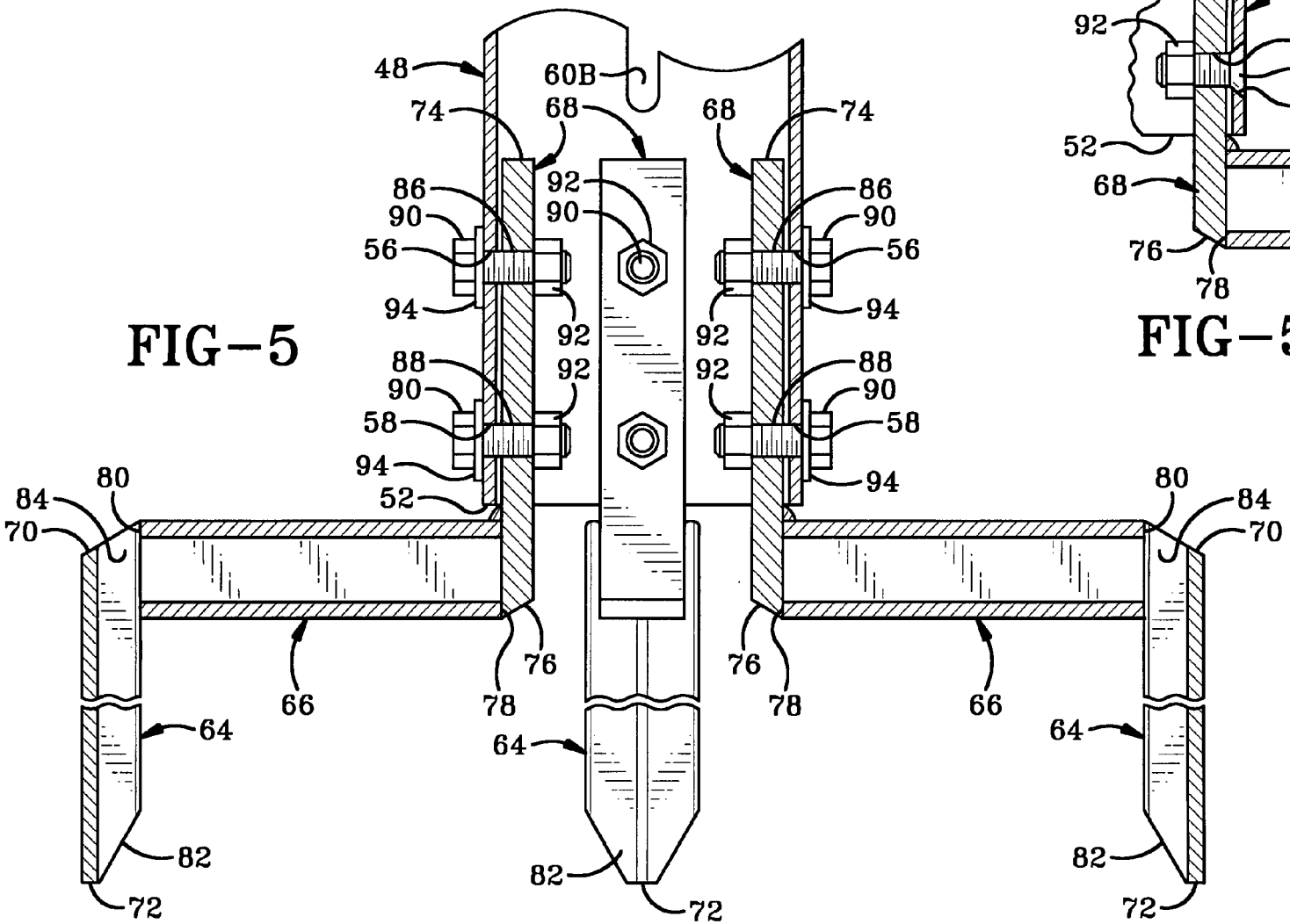
FIG. 5 is a sectional view taken on line 5-5 of FIG. 4.

With reference to FIGS. 4 and 5, four sets of upper and lower through holes 86 and 88 are formed in each leg 68 extending from its outer to its inner surface and respectively aligned with holes 56 and 58 of post 48 when mounted thereon for respectively receiving fasteners there through. These fasteners in the exemplary embodiment include a bolt 90 having an externally threaded shaft, a nut 92 threadedly engaging the threaded shaft and a washer 94 through which the threaded shaft passes. FIG. 5A shows an alternate fastener having a counter sunk head. More particularly, post 48 may be formed with a tapered hole 96 for receiving therein a tapered head 98 of an alternate bolt which is threadedly engaged with a nut 92. In either case, the bolts and nuts and washers, if used, rigidly secure mounting leg 68 to the side wall of post 48. In FIG. 5, legs 68 are disposed within the interior chamber defined by the side wall of post 48 although they may also be positioned external to post 48 and similarly secured by bolts or other fasteners.

With reference to FIGS. 1-3, post 16 of mailbox assembly 12 is secured to post 48 via a pair of fasteners in the form of upper and lower bolts 100, nuts 102 which threadedly engage a threaded portion of bolt 100 and optionally front and rear washers 104A and 104B. The shaft of bolt 100 passes through a horizontal hole 106 formed through walls 36, 38 and 39, and also through slots 60 or 62 which are aligned respectively with holes 106. Slots 60 and 62 allow for the vertical adjustment of bolts 100 depending on where they pass through post 16 in order to facilitate alignment.

Figure 7:
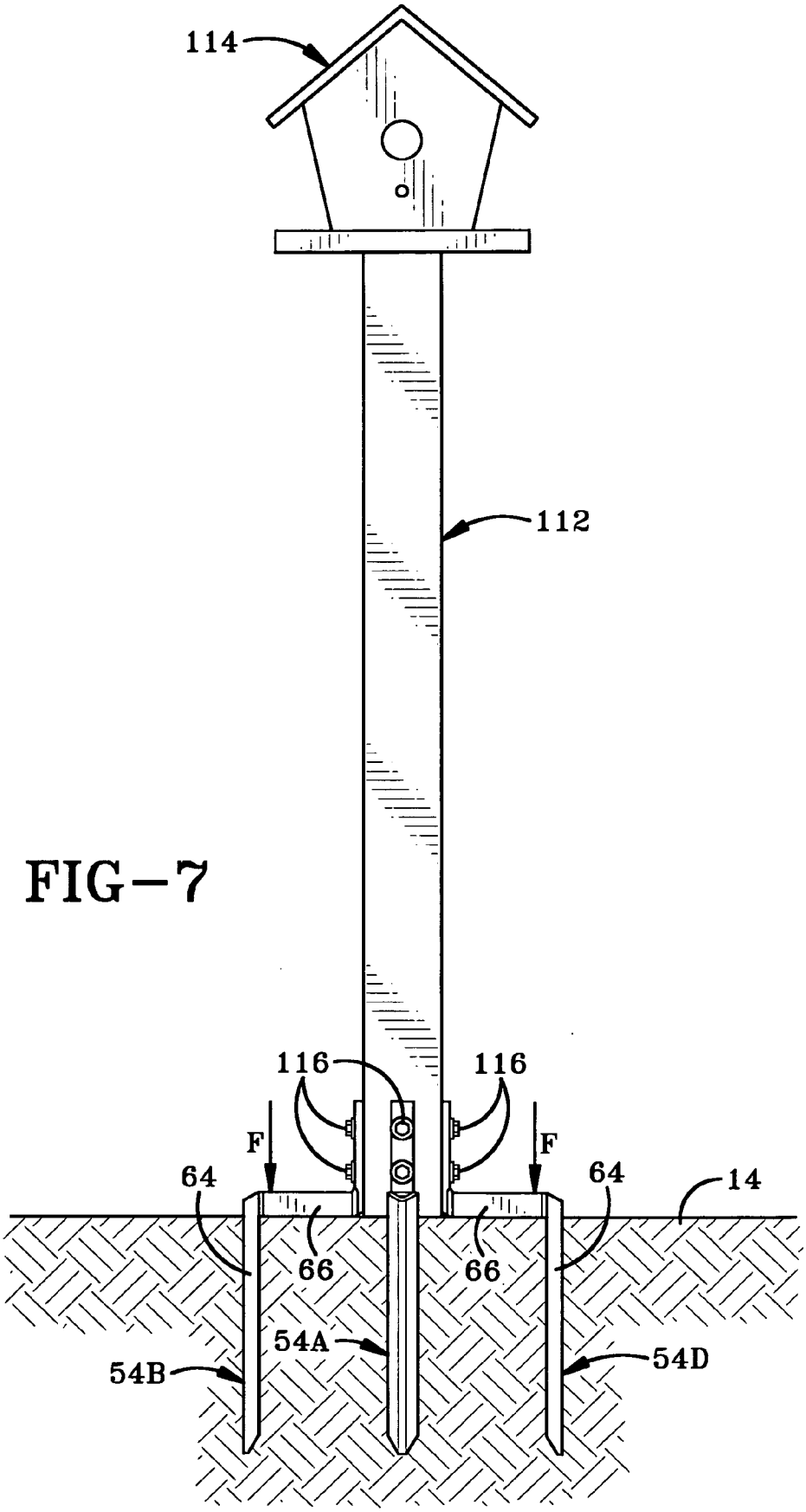
FIG. 7 is a front elevational view showing the stakes mounted on an alternate post for supporting a birdhouse.

As shown in FIG. 6, stake members 54 may be mounted on post 16 directly whereby support post 48 is eliminated. More particularly, upper and lower fasteners 108 may be used which pass through respective holes 110 formed through various front or side walls of post 16 so they are aligned with the holes formed in legs 68. Fasteners 108 typically also include a bolt with a nut threadedly engaging the bolt and/or washers as is appropriate. FIG. 7 shows an alternate configuration in which stake members 54 may be secured to an alternate post 112 adjacent its lower end in order to mount a birdhouse 114 adjacent the top of post 112. More particularly, post 112 may be formed of wood or another rigid material which defines therein holes adjacent its lower end into which fasteners 116 extend. Fasteners 116 may be screws or lag bolts for instance which extend through the holes in legs 68 and into corresponding holes adjacent lower end of post 112. Mounting legs 68 are thus secured on the outer surface of post 112. As previously noted, preferably the height of arms 66 is no more than 1 to 1½ inches whereby no portion of arms 66 or spikes 64 disposed outwardly of post 112 extends upwardly above the upper surface of ground 14 more than 1 to 1½ inches in order to minimize problems with lawn mower blades or personal injury.

As shown in FIGS. 2, 6 and 7, the turf anchor may be installed in ground 14 by the application of a downward force (Arrows F) on the top of arm 66 and/or the upper end 70 of spikes 64. Arrows F represents this force generally and in particular represent the application of such a force by a foot, hammer, or another suitable device. Installation of the turf anchor shown in FIGS. 1-5 may be accomplished by the application of this force prior to the mounting of mailbox assembly 12 on post 48. Although this may likewise be the case with the configuration shown in FIG. 6, it is more likely that spikes 54 will be pressed downwardly into ground 14 after stake members 54 have been secured to post 16. This would also most likely be the case with regard to the configuration shown in FIG. 7 for the mounting of birdhouse 114.

The turf anchor of the present invention is thus effective for use in securing an above ground post to the ground, and may be utilized for mounting a variety of outdoor items. The turf anchor conveniently provides for easy mounting simply by pressing downwardly with one's foot on the stake members or hammering the stake members into the ground. The turf anchor also provides for substantial stability via the use of three or four spikes which are spaced from one another and which preferably are spaced outwardly from the post which they are supporting to provide substantial stability. The present turf anchor is also configured to provide the sole support for the various uprights, posts and other structures mounted thereon. For instance, only the stake members of each of the configurations described herein are used in order to anchor to ground 14 the various structures previously discussed such as support post 48, mailbox assembly 12, and post 112 with birdhouse 114. The present invention thus preferably operates without the use of guy wires which are secured to a post or other structure at a relatively elevated position above the ground and angle downwardly and outwardly to a separate stake or other structure mounted within the ground. Likewise, the present invention is configured to support the posts or other above ground structures without other braces which are secured at a relatively elevated position to the above ground structures and extend outwardly and downwardly to stakes or other anchors in the ground, or outwardly to the side or upwardly to other structures nearby for providing additional support. In short, the turf anchor the present invention is configured to provide the sole support so that the various posts and other above ground structures described herein are free standing other than the anchoring that the present turf anchor provides.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:

a first upright having an upper end and a lower end whereby the upright is adapted to be positioned with its lower end adjacent the ground and extend upwardly therefrom to its upper end;

a turf anchor comprising first, second and third stake members;

the first stake member comprising a first radial arm, a first substantially vertical spike secured to and extending downwardly from the first radial arm, and a first mounting leg secured to and extending upwardly from the first radial arm;

the second stake member comprising a second radial arm, a second substantially vertical spike secured to and extending downwardly from the second radial arm, and a second mounting leg secured to and extending upwardly from the second radial arm;

the third stake member comprising a third radial arm, a third substantially vertical spike secured to and extending downwardly from the third radial arm, and a third mounting leg secured to and extending upwardly from the third radial arm;

wherein the first, second and third mounting legs are spaced from one another;

the first, second and third radial arms respectively extend radially outwardly from the first, second and third mounting legs to the first, second and third spikes; and the first, second and third substantially vertical spikes are spaced from one another and extend downwardly below the lower end of the upright and are configured to be pressed downwardly into the ground to secure the upright to the ground;

a first stake-mounting bolt extending from the first mounting leg to the first upright adjacent the lower end thereof to secure the first stake member to the first upright; and a second stake-mounting bolt extending from the second mounting leg to the first upright adjacent the lower end thereof to secure the second stake member to the first upright.

2. The apparatus of claim 1 further comprising a substantially vertical post secured to the upright; and a vertically elongated slot formed in one of the post and upright; and a fastener extending through the slot from the post to the upright for securing the post to the upright; the fastener vertically slidable within the slot to allow for vertical adjustment of the post relative to the upright while the fastener extends through the slot.

3. The apparatus of claim 1 further comprising a mailbox secured to the upper end of the first upright.

4. The apparatus of claim 1 wherein each of the first, second and third mounting legs extends upwardly from the lower end of the first upright into a cavity formed in the first upright.

5. The apparatus of claim 4 wherein the first and second stake-mounting bolts extend radially outward respectively from the first and second mounting legs to the first upright.

6. The apparatus of claim 5 wherein the first upright is a generally hollow structure having a double walled construction; and each of the first and second stake-mounting bolts extends through two spaced walls of the double walled construction.

7. The apparatus of claim 6 wherein the first upright comprises:

a vertical front wall which has first and second outer ends;

a vertical intermediate wall which has first and second outer ends and is spaced rearwardly from the vertical front wall;

a first vertical outer side wall which is connected to and extends rearwardly from the first outer end of the vertical front wall to a rear end of the first vertical outer side wall;

a second vertical outer side wall which is connected to and extends rearwardly from the second outer end of the vertical front wall to a rear end of the second vertical outer side wall;

a first vertical inner side wall which is spaced from the first vertical outer side wall and which is connected to and extends rearwardly from the first outer end of the intermediate wall to a rear end of the first vertical inner side wall;

a second vertical inner side wall which is spaced from the second vertical outer side wall and which is connected to and extends rearwardly from the second outer end of the intermediate wall to a rear end of the second vertical inner side wall;

a first vertical back wall connected to and extending between the rear end of the first outer side wall and the rear end of the first inner side wall; and a second vertical back wall connected to and extending between the rear end of the second outer side wall and the rear end of the second inner side wall.

8. The apparatus of claim 7 wherein the first stake-mounting bolt extends through the front and intermediate walls.

9. The apparatus of claim 8 wherein the second stake-mounting bolt extends through the first outer side wall and first inner side wall.

10. The apparatus of claim 7 wherein the first stake-mounting bolt extends through the first outer side wall and first inner side wall.

11. The apparatus of claim 10 wherein the second stake-mounting bolt extends through the second outer side wall and second inner side wall.

12. The apparatus of claim 7 further comprising a rear entrance opening of the cavity between the first and second back walls.

13. The apparatus of claim 4 further comprising a rear entrance opening of the cavity extending from adjacent the upper end of the first upright to adjacent the lower end of the first upright.

14. The apparatus of claim 1 further comprising a second upright is a generally hollow structure having a double walled construction, and which has a lower end adjacent the lower end of the first upright and an upper end higher than the upper end of the first upright; and an upright-mounting bolt which extends from the first upright to the second upright and through two spaced walls of the double walled construction to secure the second upright to the first upright.

15. The apparatus of claim 1 further comprising a second upright which has a lower end adjacent the lower end of the first upright and an upper end higher than the upper end of the first upright; and a cavity formed in the second upright having a rear entrance opening and a bottom entrance opening at the lower end of the second upright;

wherein the first upright is within the cavity with the lower end of the first upright adjacent the bottom entrance opening and the rear entrance opening extending from the lower end of the second upright to above the upper end of the first upright.

16. The apparatus of claim 1 further comprising a second upright which has a lower end adjacent the lower end of the first upright and an upper end higher than the upper end of the first upright; and a first upright-mounting bolt which is higher than the first and second stake-mounting bolts and extends from the first upright to the second upright to secure the first upright to the second upright.

17. The apparatus of claim 16 wherein the first upright-mounting bolt is adjacent the upper end of the first upright.

18. A method comprising:

securing a first upright adjacent a lower end thereof to a turf anchor;

pressing first, second and third substantially vertical spikes of the turf anchor into the ground to secure the first upright to the ground so that the first upright extends upwardly from the ground to an upper end;

providing a second upright with a mailbox secured to an upper end thereof;

positioning a lower end of the second upright adjacent the lower end of the first upright so that a cavity formed in the second upright receives therein the first upright;

securing in a secured position the second upright to the first upright so that a rear entrance opening of the cavity extends upwardly from the lower end of the second upright to above the upper end of the first upright in the secured position.

19. The method of claim 18 wherein securing the second upright to the first upright comprises securing the second upright to the first upright with a bolt which extends from the first upright to the second upright.

20. The method of claim 19 wherein securing the first upright to the turf anchor comprises securing the first upright to the turf anchor with a bolt which extends from the first upright to the turf anchor.

* * * * *